US006345716B1

(12) United States Patent
Chapman

(10) Patent No.: US 6,345,716 B1
(45) Date of Patent: Feb. 12, 2002

(54) COMBINED CLAMSHELL AND MANNEQUIN FORM PACKAGING ASSEMBLY

(76) Inventor: Michael Chapman, 631 Cliff Dr., Unit 1A, Laguna Beach, CA (US) 92651

( * ) Notice: Subject to any disclaimer, the term of this patent is extended or adjusted under 35 U.S.C. 154(b) by 0 days.

(21) Appl. No.: 09/482,966

(22) Filed: Jan. 11, 2000

(51) Int. Cl.[7] ..... B65D 73/00
(52) U.S. Cl. ..... 206/471; 206/458
(58) Field of Search ..... 206/5, 458, 461, 206/471, 579

(56) References Cited

U.S. PATENT DOCUMENTS 1,434,279 A * 10/1922 Baum ..... 206/458
2,893,546 A * 7/1959 Kendall et al. ..... 206/471
4,453,629 A * 6/1984 Goldberg ..... 206/471
4,485,921 A * 12/1984 Geller ..... 206/471
4,552,264 A * 11/1985 Quarrell et al. ..... 206/458
4,653,642 A * 3/1987 Hakun et al. ..... 206/471
4,733,775 A * 3/1988 Fireman ..... 206/5
H833 H * 11/1990 Brindle
5,845,778 A * 12/1998 Hickey, Jr. ..... 206/461
6,003,672 A * 12/1999 Chapman et al. ..... 206/5
6,152,298 A * 11/2000 Dods ..... 206/471

* cited by examiner

*Primary Examiner*—David T. Fidei
(74) *Attorney, Agent, or Firm*—Leonard Tachner

(57) ABSTRACT

A retail display packaging assembly which combines a transparent plastic clamshell and a mannequin face (or other mannequin body parts) to provide an advantageous display for selected products. In a preferred embodiment disclosed herein, the product comprises a snorkeling set having a snorkel tube and a swimmer's mask. The mannequin face is positioned within the clamshell for retaining the swimmer's mask over the eyes and nose of the mannequin in much the same manner as an actual swimmer would wear the mask. In addition, the snorkel tube is positioned relative to the mannequin face in much the same manner as it would be positioned adjacent a swimmer's face. The clamshell is vacuum formed from a clear sheet of PVC plastic and the bottom portion of the clamshell is configured to provide upper and lower parts that are congruent to the mannequin face and have a gap for receiving the strap of the swimmer's mask. The mannequin face is secured to the congruent parts by respective tabs and recesses and thus secures the mask which encircles the mannequin face. The mannequin face is preferably vacuum formed from an opaque PVC plastic and thus provides a highly visible face-shaped structure "wearing" the mask and snorkel within a transparent packaging container.

5 Claims, 5 Drawing Sheets

COMBINED CLAMSHELL AND MANNEQUIN FORM PACKAGING ASSEMBLY

BACKGROUND OF THE INVENTION

1. Field of the Invention

The present invention pertains generally to the field of product packaging for retail display and more specifically to a method and assembly for packaging a product normally worn on a portion of the human body, such as a mask for water sports or a watch or bracelet.

2. Background Art

Effectively packaging a product for retail display requires consideration of a number of different issues. One important issue is packaging size because shelf space in most retail stores is a limited commodity. Another important concern is catching the retail consumer's eye by displaying the product in an interesting manner such as by employing see-through materials. Another issue is in providing a hangable package that can be hung on a display hook. Yet another concern is in providing a display and packaging combination which shows the product in condition for its intended use. This concern is especially significant when the product is to be worn on a portion of the human body, such as on the face or wrist for example. Yet perhaps the most important aspect of effective retail display packaging is the relative cost of the packaging which should be commensurate with the cost of the product.

SUMMARY OF THE INVENTION

The present invention comprises a retail display packaging assembly which combines a transparent plastic clamshell and a mannequin face (or other mannequin body parts) to provide an advantageous display for selected products. In a preferred embodiment disclosed herein, the product comprises a snorkeling set having a snorkel tube and a swimmer's mask. The mannequin face is positioned within the clamshell for retaining the swimmer's mask over the eyes and nose of the mannequin in much the same manner as an actual swimmer would wear the mask. In addition, the snorkel tube is positioned relative to the mannequin face in much the same manner as it would be positioned adjacent a swimmers face.

In an important aspect of the invention; the clamshell is vacuum formed from a clear sheet of PVC plastic and the bottom portion of the clamshell is configured to provide upper and lower parts that are congruent to the mannequin face and have a gap for receiving the strap of the swimmer's mask. The mannequin face is secured to the congruent parts by respective tabs and recesses and thus secures the mask which encircles the mannequin face. The mannequin face is preferably vacuum formed from an opaque PVC plastic and thus provides a highly visible face-shaped structure "wearing" the mask and snorkel within a transparent packaging container. Thus the present invention meets all of the aforementioned concerns and issues for effective retail product display. Moreover, the invention provides a unique means for employing mannequin body parts to secure products having straps, bands, bracelets and the like. By way of example, the present invention could readily be embodied in a package containing and displaying a watch by using a mannequin hand, wrist and forearm in the manner described herein.

OBJECTS OF THE INVENTION

It is therefore a principal object of the present invention to provide a packaging assembly and method of fabrication thereof, the assembly providing a retail display package having at least one mannequin body part for presenting a product in its wearer configuration.

It is another object of the invention to provide a packaging method and assembly wherein a clamshell container has vacuum formed mannequin parts made congruent to a mannequin form to mate the form to the clamshell for receiving a product worn by the mannequin form for effective product display.

It is yet another object of the invention to provide a method of fabricating a packaging assembly having an opaque mannequin body part in a transparent container and permitting a product having a strap or band to be worn on the mannequin body part with the strap or band partially hidden to preclude visual interference with the product display.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
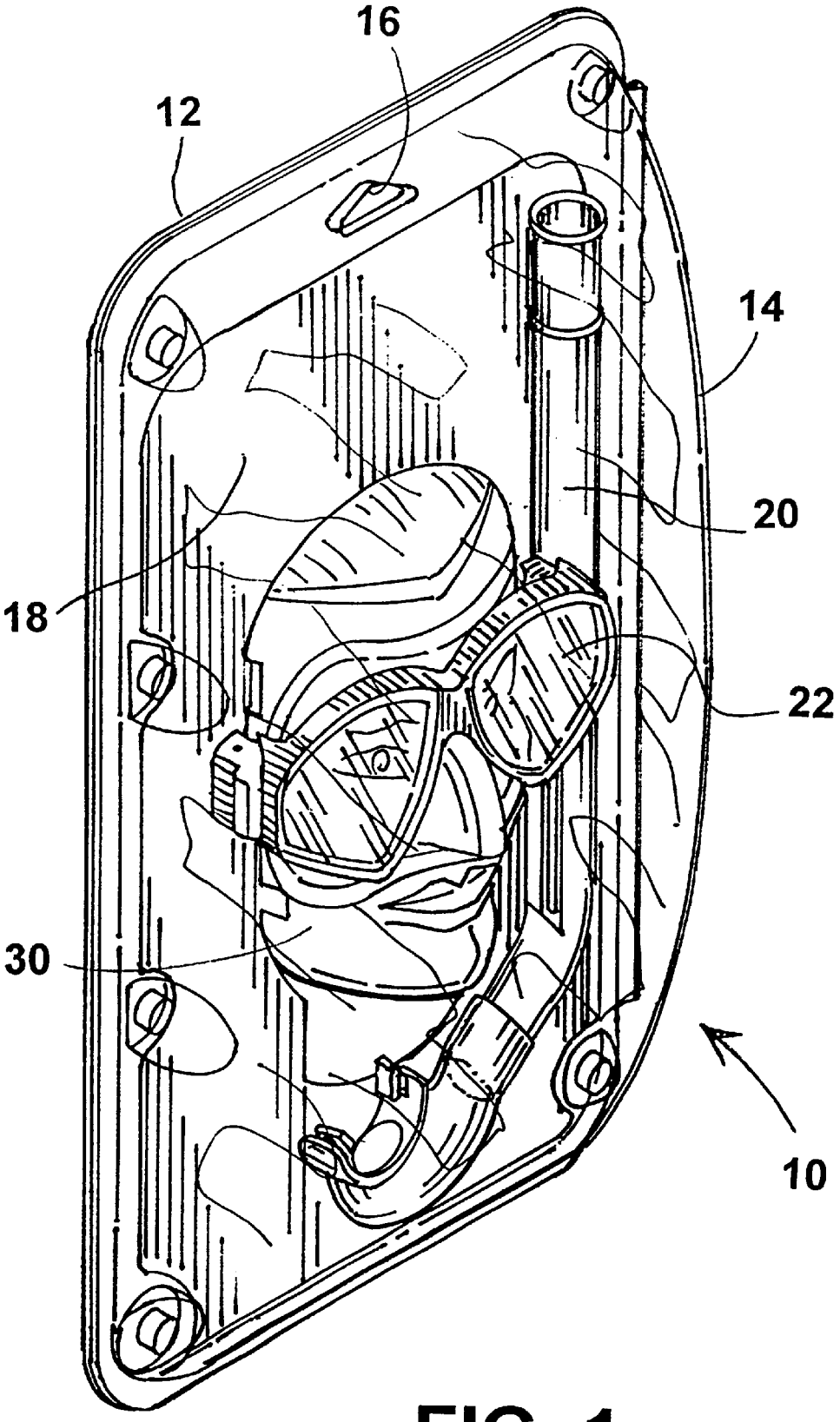
FIG. 1 is a three-dimensional view of a preferred embodiment of the invention used for display packaging a snorkel and mask.

Referring now to the accompanying drawings, it will be seen that in accordance with a preferred embodiment of the present invention, a combined clamshell and mannequin face packaging assembly 10 comprises a clamshell bottom portion 12 and a clamshell top portion 14 interconnected by a live hinge 15 (see FIG. 2) to form an interior chamber 18. Both portions 12 and 14 are provided with a hanging aperture 16 to permit the packaging assembly 10 to be hung on a display hook, and a plurality of protrusions 24 and receptacles 26 to close and lock the two portions. Mounted in interior chamber 18 are a snorkel 20 and a swim mask 22, the latter being installed on a mannequin facial form 30 so that the goggles 23 and nose seal 25 appear to be positioned in a manner which is anatomically correct on form 30.

Figure 2:
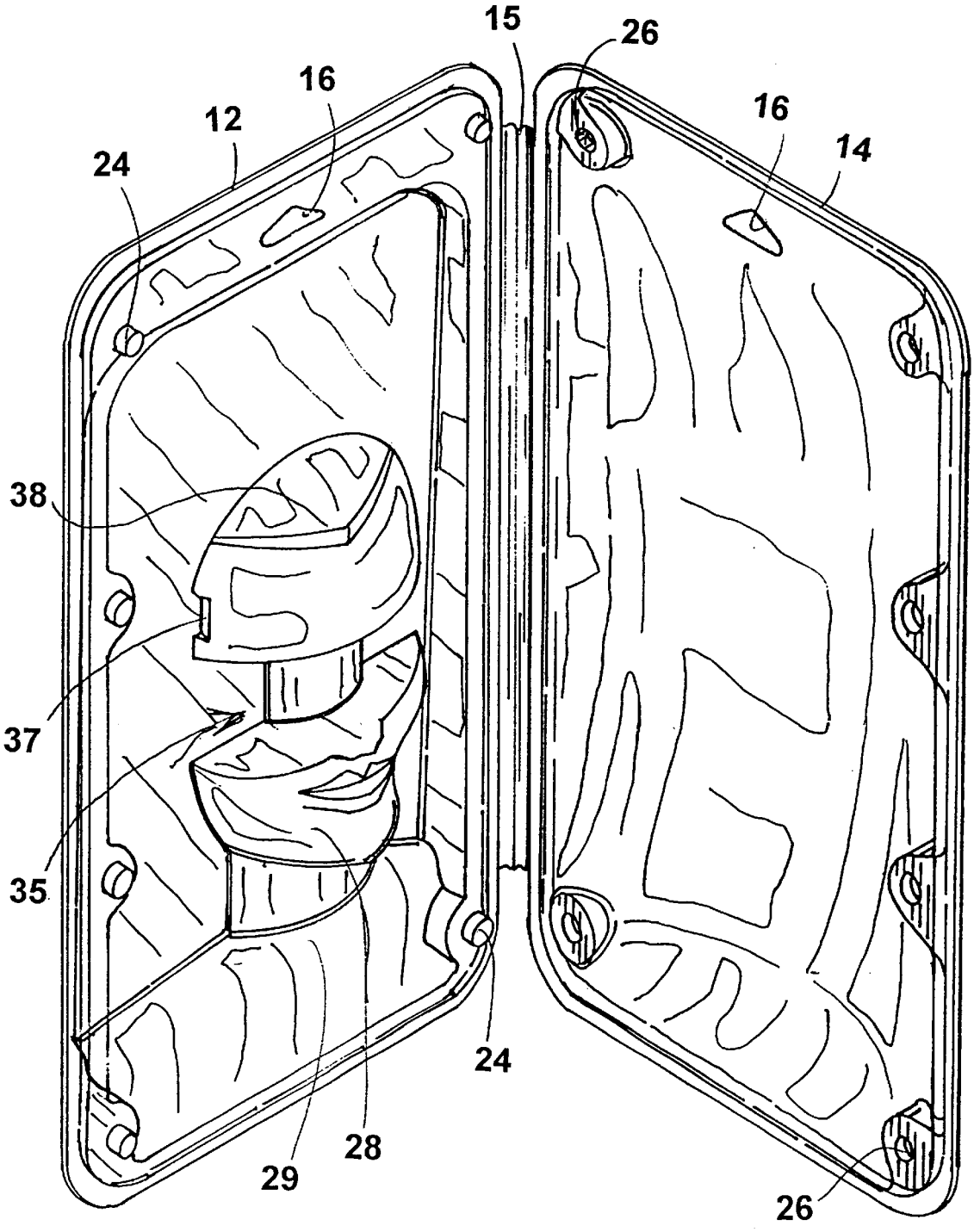
FIG. 2 is a three-dimensional view of a transparent clamshell container used in the embodiment of FIG. 1.
Figure 4:
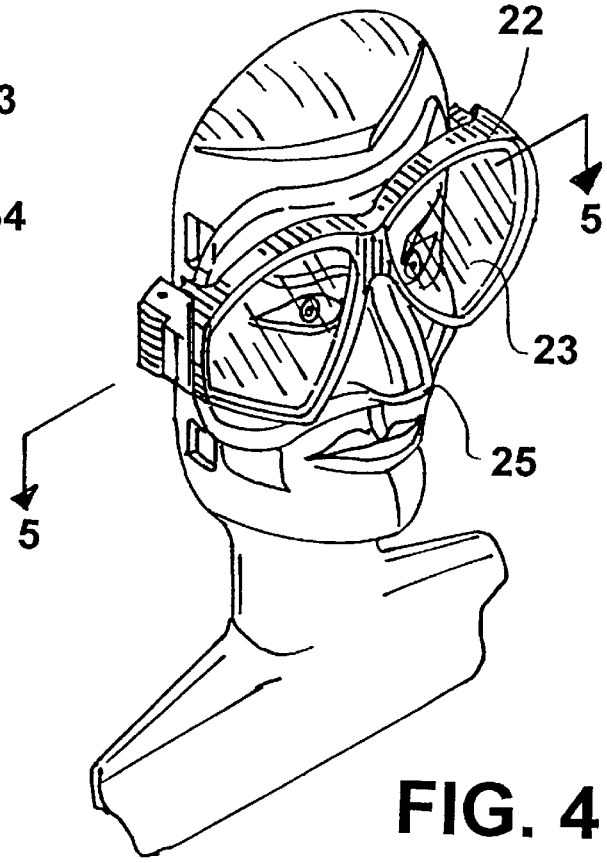
FIG. 4 is a three-dimensional view of the mannequin body part of FIG. 3 shown with a swimmer's mask.
Figure 8:
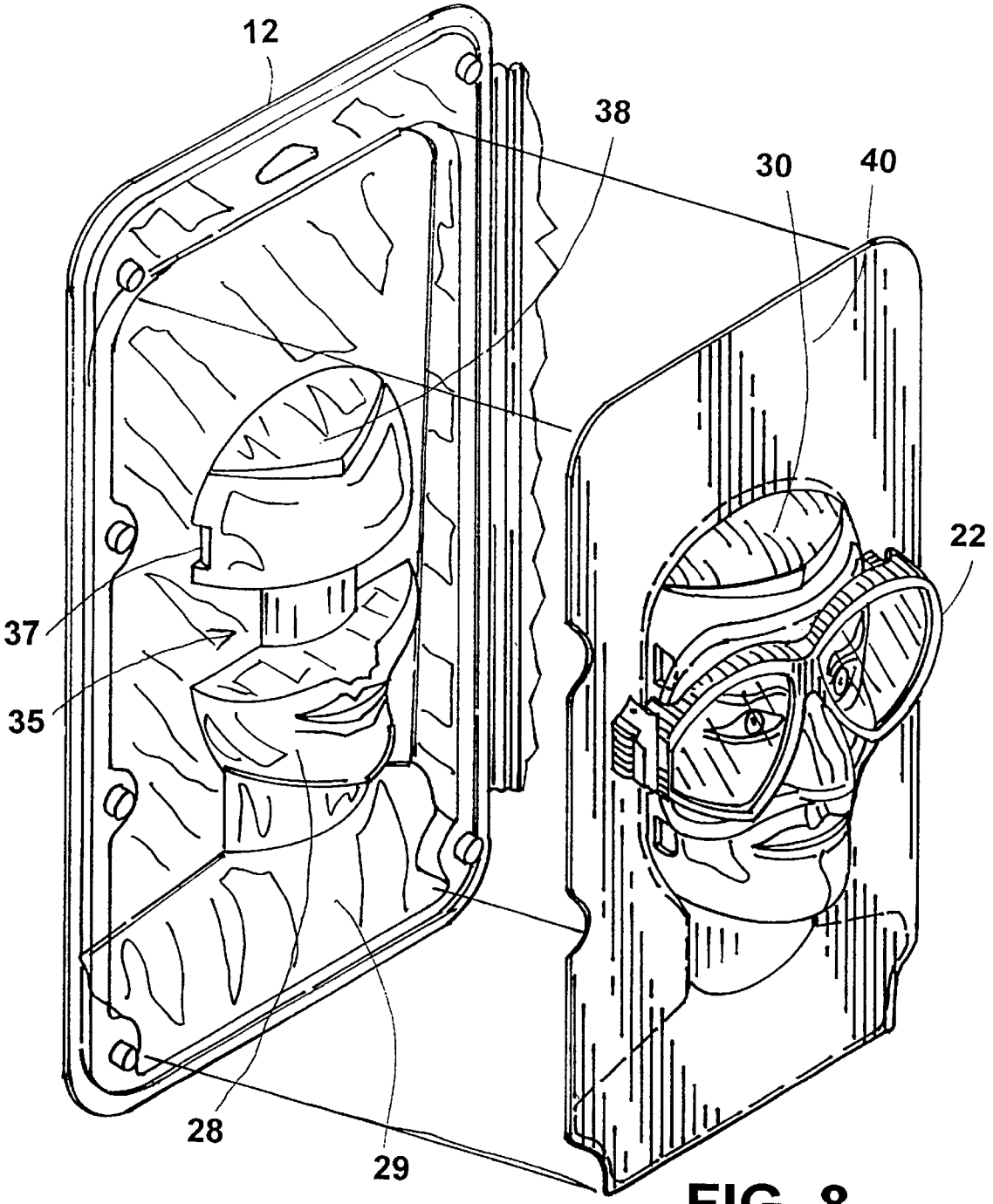
FIG. 8 is an exploded view illustrating the relationship between the sub-assembly of FIG. 7 and the clamshell container of FIG. 2.

As seen best in FIGS. 2 and 8, bottom portion 12 is provided with a pair of mannequin regions which, as will be seen hereinafter, are respectively congruent to portions of the mannequin facial form 30. More specifically, clamshell bottom portion 12 comprises a lower face region 28, a shoulder and neck region 29 and an upper head portion 38. Of particular significance is a gap 35 between lower face region 28 and upper head portion 38. Gap 35 is essentially a removed or missing portion which corresponds to that portion of facial form 30 to which the mask 22 is to be connected. Gap 35 receives the strap 27 (see FIG. 5) of mask 22. Strap 27 will be folded behind the opaque facial form 30 in the manner shown in FIGS. 4 and 5.

Figure 3:
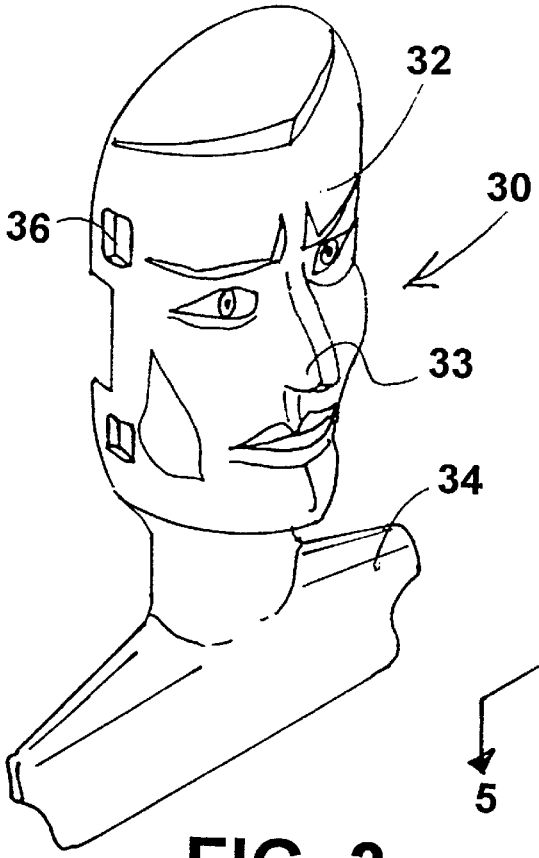
FIG. 3 is a three-dimensional view of an opaque mannequin body part used in the embodiment of FIG. 1.
Figure 5:
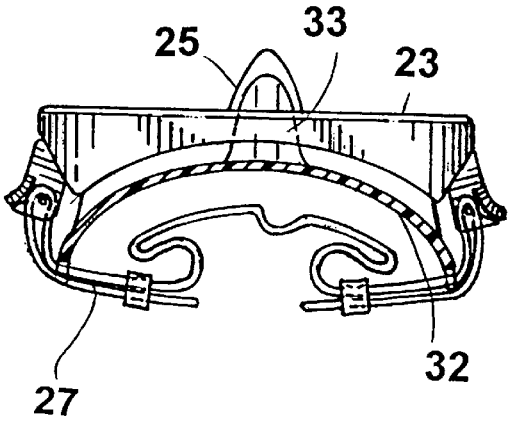
FIG. 5 is a cross-sectional view taken along lines 5—5 of FIG. 4.
Figure 6:
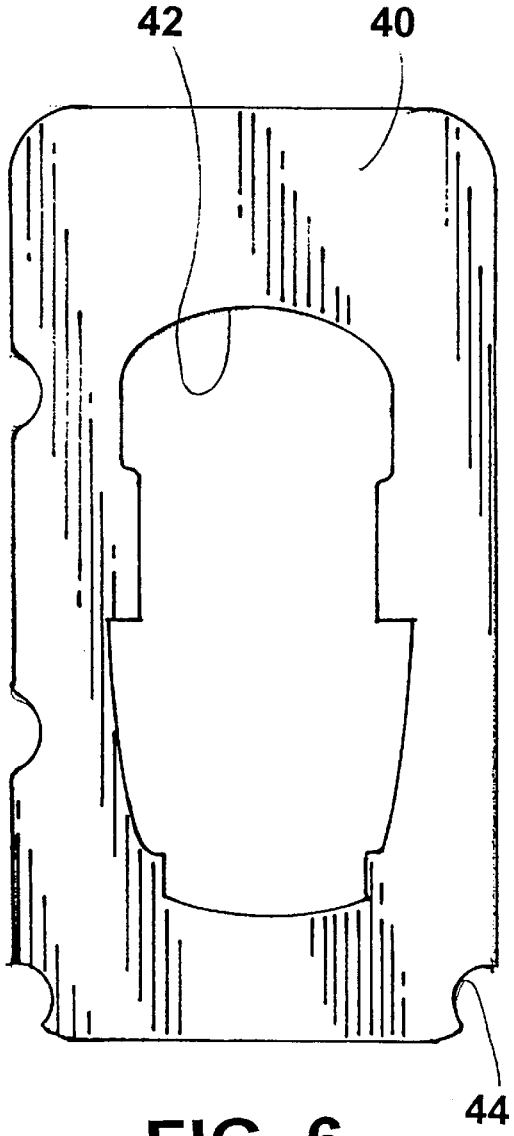
FIG. 6 is an elevational view of an insert card used in the preferred embodiment.
Figure 7:
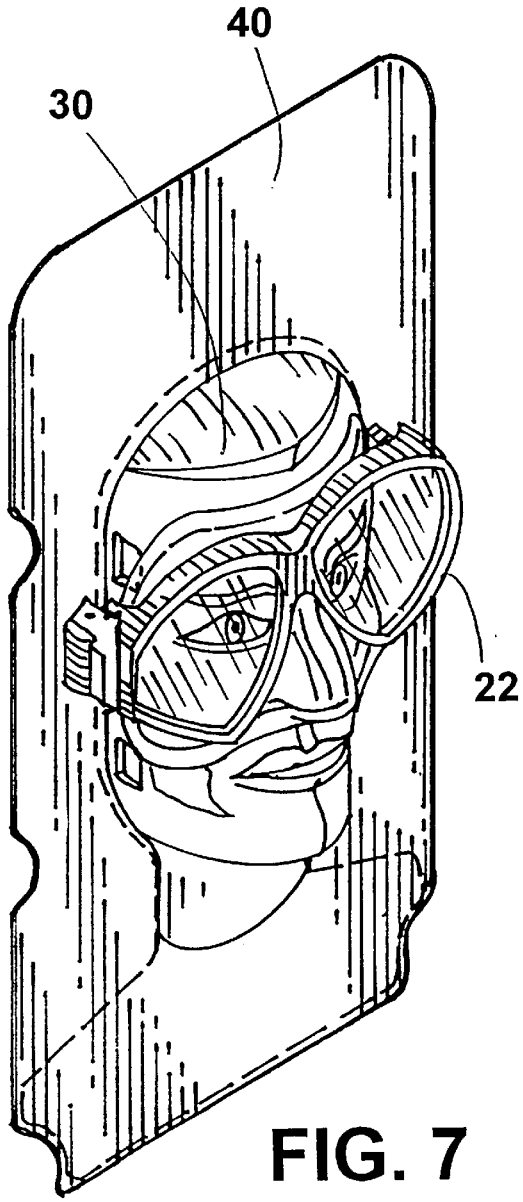
FIG. 7 is a three-dimensional view of a sub-assembly of the invention.

As seen best in FIGS. 3 and 5, mannequin facial form 30 comprises a head portion 32, facial portion 33 and shoulder and neck portion 34. A plurality of tabs 36 are designed to mate with recesses 37 in clamshell bottom portion 12 (see FIG. 2) to secure the mannequin facial form 30 to clamshell bottom portion 12. An insert card 40 shown in FIG. 6 is optionally provided to receive graphics and enhance the aesthetic appearance of package 10 by providing a colorful background. Insert card 40 comprises an interior cutout 42 to receive the facial form 30 and swim mask 22 as an assembly shown in FIG. 7 in the manner depicted in FIG. 8. Insert card 40 also has a plurality of exterior cutouts 44 designed to accommodate protrusions 24 and receptacles 26 in the manner shown in FIG. 2.

The method steps for achieving the embodiment of the package assembly 10 as described above comprise the following:

1. Vacuum form a clear sheet of PVC into a rectangular packaging clamshell. The bottom half of the clamshell will incorporate the facial profile of a human face, with the area from the bottom of the nose to the mid-point of the forehead carved out to form a large cavity. This cavity will be used as a reservoir to contain the strap section of a diving mask.

2. The lower clamshell face will also have molded into it two or more small cavities on the perimeter of the face that will serve to mate the top face bearing the diver's mask.

3. Vacuum form from an opaque sheet of PVC a face identical to the face on the lower half of the clamshell, but with the nose, eyes and lower forehead section intact. The opaque face will also contain two or more small cavities that are in the same position as the cavities on the face in the clamshell. The male section of the cavities on the opaque face will fit snugly into the female cavities of the lower face.

4. Mount the dive mask on the opaque face, with the center of the glass lens of the mask directly in front of the eyes of the face. This will closely approximate the position a dive mask would appear on a scuba diver's or snorkeler's face.

5. Pull the straps of the dive mask over the top of the opaque face.

6. The insert card, printed from light cardboard, is used to bear graphics and to frame the diver's face. Insert the shoulder section of the opaque face through the die cut opening of the insert card, so that the insert card covers the shoulder area of the face.

7. Assemble the insert card and the opaque face with mask into the bottom section of the clamshell. The straps of the mask should be deposited directly into the facial cavity of the lower section. This will enable the opaque face with mask to be closely married to the partial face at the bottom of the clamshell without any interference from the mask strap. This will also place the mask straps behind the face, or in the same relative position that a diver or snorkeler would place the straps before entering the water. Folding the straps and placing them in the open cavity of the mask and then placing the mask on top of the face is not acceptable as the eyes of the face cannot then be seen through the straps. In addition, the straps help secure and keep the mask on the face when wrapped around the face.

8. The two or more small mating cavities on the opaque face and the lower face should mate together to insure a close fit between the face forms.

9. The insert card should be laid flat against the bottom of the clamshell so that the insert card frames the opaque face bearing the mask.

10. Insert the snorkel into the area directly on top of the insert card at a position on the right side of the facing mask. This positions the snorkel in the correct position that a diver or snorkeler would use when mounting the snorkel to the mask strap.

11. With both the mask and snorkel in place and the mask strap secured behind the opaque face, close the clamshell and lock the top of the clamshell to the bottom section with the snap buttons or protrusions and receptacles molded into the two sections. The upper clamshell should close easily over the mask, avoiding any pressure that might distort the nose pocket of the mask or cause the clamshell to open inadvertently.

12. Test to make sure that all components are correctly in place by picking up and shaking the final assembly in a variety of positions. The mask should not become dislodged from the face, and the opaque face should not lift off the lower supporting face. The snorkel should also remain in position to the right of the facing mask.

Having thus disclosed a preferred embodiment of the assembly and method of the invention, it being understood that many variations and additions are contemplated,

What is claimed is:

1. A packaging assembly comprising:

a transparent clamshell container having top and bottom clamshell portions; and a mannequin head, face and shoulder form contained within said container for holding a product packaged in said assembly;

at least one of said clamshell portions being shaped in part to conform to said mannequin form to secure said mannequin form to said container.

2. The packaging assembly recited in claim 1 further comprising a gap in said clamshell portion shaped in part to conform to said mannequin form, said gap providing in a hidden region beneath said mannequin form for receiving a product strap.

3. The packaging assembly recited in claim 1 wherein said mannequin form comprises an opaque material.

4. The packaging assembly recited in claim 1 wherein said container is made of vacuum formed plastic.

5. The packaging assembly recited in claim 1 wherein said mannequin form is made of vacuum formed plastic.

* * * * *